US009483969B2

(12) United States Patent
Wang

(10) Patent No.: US 9,483,969 B2
(45) Date of Patent: Nov. 1, 2016

(54) LIQUID CRYSTAL PANEL, AND TESTING CIRCUIT AND TESTING METHOD THEREOF

(71) Applicant: SHENZHEN CHINA STAR OPTOELECTRONICS TECHNOLOGY CO., LTD., Guangdong (CN)

(72) Inventor: Jinjie Wang, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 107 days.

(21) Appl. No.: 14/006,087

(22) PCT Filed: Jul. 1, 2013

(86) PCT No.: PCT/CN2013/078560

§ 371 (c)(1),
(2) Date: Sep. 18, 2013

(87) PCT Pub. No.: WO2014/201729

PCT Pub. Date: Dec. 24, 2014

(65) Prior Publication Data

US 2014/0375344 A1 Dec. 25, 2014

(30) Foreign Application Priority Data

Jun. 20, 2013 (CN) ..... 2013 1 02472341

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01)

(58) Field of Classification Search
CPC ..... G09G 3/006
USPC ..... 324/750.3, 760.02
See application file for complete search history.

(56) References Cited

U.S. PATENT DOCUMENTS

| | | | | |
|---|---|---|---|---|
| 5,233,448 | A * | 8/1993 | Wu | 349/40 |
| 6,008,061 | A * | 12/1999 | Kasai | 438/18 |
| 6,013,923 | A * | 1/2000 | Huang | 257/59 |
| 6,246,074 | B1 * | 6/2001 | Kim et al. | 257/48 |
| 7,605,904 | B2 * | 10/2009 | Wu et al. | 349/192 |
| 2007/0018680 | A1 * | 1/2007 | Jeon et al. | 324/770 |
| 2010/0127258 | A1 * | 5/2010 | Kang et al. | 257/48 |
| 2010/0141293 | A1 * | 6/2010 | Chen et al. | 324/770 |

* cited by examiner

*Primary Examiner* — Jermele M Hollington
*Assistant Examiner* — Zannatul Ferdous
(74) *Attorney, Agent, or Firm* — Andrew C. Cheng

(57) ABSTRACT

A liquid crystal panel, the testing circuit and the testing method thereof are disclosed. The testing circuit includes shorting bars, bonding pads, and switches. The switches are arranged between the shorting bars and the bonding pads. In the testing process, the switches are turn on upon receiving the testing signals so as to transmit the testing signals from the shorting bars to the bonding pads. When the testing process ends, the switches are turn off to prevent the liquid crystal panel from being affected by the signals of the bonding pads during the normal screen display of the liquid crystal panel. In this way, the manufacturing cost is reduced.

15 Claims, 4 Drawing Sheets

LIQUID CRYSTAL PANEL, AND TESTING CIRCUIT AND TESTING METHOD THEREOF

BACKGROUND OF THE INVENTION

1. Field of the Invention

The present disclosure relates to liquid crystal display technology, and more particularly to a liquid crystal panel, and the testing circuit and the testing method thereof.

2. Discussion of the Related Art

In the manufacturing process of the liquid crystal panel, signals are input to the liquid crystal panel via different interfaces to check if the liquid crystal panel is defective. Usually, the light-on testing may be performed once or twice. In the twice-light-on process, shorting bars are adopted to perform the corresponding testing. Specifically, one end of the bonding pads connect to a display area of the liquid crystal panel, and the other end of the bonding pad connects to one shorting bar. In addition, two ends of the shafting bar connect testing bonding pads. During, the testing process, testing signals are input via the testing bonding pads and are then transmitted to the bonding pads via the shorting bars. When the testing process ends, the laser cut process has to be performed to disconnect the shorting bar and the bonding pads.

Though the above testing method is simple and the demand toward the precision is low, the additional laser cut process not only prolongs the manufacturing process, but also needs to be performed by additional equipment.

SUMMARY

The object of the invention is to provide a liquid crystal panel, and the testing circuit and the testing method thereof.

In one aspect, a testing circuit of a liquid crystal panel include: a plurality of shorting bars, two ends of the shorting bar couple testing bonding pads so as to obtain testing signals from the testing bonding pads; a plurality of bonding pads, one end of the bonding pads couples with the shorting bar, and the other end of the bonding pads couples a display area of the liquid crystal panel so as to transmit the testing signals to the display area; and wherein at least one set of switches is arranged between the bonding pads and the shorting bars, the switches are turn on upon receiving the testing signals, and then transmit the testing signals from the shorting bars to the bonding pads in a testing process, and the switches are turn off when the testing process ends so as to prevent the liquid crystal panel from being affected b the signals of the bonding pads when the liquid crystal panel displays normally.

Wherein two additional bonding pads are respectively arranged on two ends of the bonding pad, and the additional bonding pads connect to the shorting bars so as to turn off the switches by the turn-off signals from the shorting bars.

Wherein the switch is a thin film transistor (TFT).

Wherein the bonding pads includes a plurality of scanning chips bonding pads, one end of the scanning chips bonding pad connects to a source of the TFT, and a gate and a drain of the TFT connect to the shorting bar.

Wherein the bonding pads includes a plurality of data chips bonding pads, the shorting bar includes a first shorting bar and a second shorting bar, one end of the data chips bonding pad connects to the source of the TFT, the gate of the TFT connects to the first shorting bar, and the drain of the TFT connects to the second shorting bar.

Wherein the additional bonding pads connect to the first shorting bar.

Wherein the testing circuit includes one TFT set, the gate and the drain of the TFT connect to the shorting bar, and the source of the TFT connects to the corresponding bonding pads.

Wherein the testing circuit includes a plurality of TFT sets, the number of the TFT is the same with the number of the bonding pads, the gate and the drain of the TFT connect to the shorting bar, and the source of the TFT connects to the corresponding bonding pads.

In another aspect, a liquid crystal panel include: a display area and a testing circuit arranged in a peripheral of the display area. The testing circuit include: a plurality of shorting bars, two ends of the shorting bar couple testing bonding pads so as to obtain testing signals from the testing bonding pads; a plurality of bonding pads, one end of the bonding pads couples with the shorting bar, and the other end of the bonding pads couples a display area of the liquid crystal panel so as to transmit the testing signals to the display area; and wherein at least one set of switches is arranged between the bonding pads and the shorting bars, the switches are turn on upon receiving the testing signals, and then transmit the testing signals from the shorting bars to the bonding pads in a testing process, and the switches are turn off when the testing process ends so as to prevent the liquid crystal panel from being affected by the signals of the bonding pads when the liquid crystal panel displays normally.

Wherein two additional bonding pads are respectively arranged on two ends of the bonding pad, and the additional bonding pads connect to the shorting bars so as to turn off the switches by the turn-off signals from the shorting bars.

Wherein the switch is a thin film transistor (TFT).

Wherein the bonding pads includes a plurality of scanning chips bonding pads, one end of the scanning chips bonding pad connects to a source of the TFT, and a gate and a drain of the TFT connect to the shorting bar.

Wherein the bonding pads includes a plurality of data chips bonding pads, the shorting bar includes a first shorting bar and a second shorting bar, one end of the data chips bonding pad connects to the source of the TFT, the gate of the TFT connects to the first shorting bar, and the drain of the TFT connects to the second shorting bar.

Wherein the additional bonding pads connect to the first shorting bar.

Wherein the testing circuit includes one TFT set, the gate and the drain of the TFT connect to the shorting bar, and the source of the TFT connects to the corresponding bonding pads.

Wherein the testing circuit includes a plurality of TFT sets, the number of the TFT is the same with the number of the bonding pads, the gate and the drain of the TFT connect to the shorting bar, and the source of the TFT connects to the corresponding bonding pads.

In another aspect, a testing method of a liquid crystal panel include: arranging at least one set of switch between shorting bars and bonding pads of the liquid crystal panel; providing testing signals to the shorting bars to turn on the switches; transmitting the testing signals to a display area of the liquid crystal panel after the testing signals enter the bonding pads via the switches; providing turn-off signals to the switches when a testing process ends so as to prevent the liquid crystal panel from being affected by the signals of the bonding pads while the liquid crystal panel displays normally.

Wherein when the providing step further includes arranging additional bonding pads on two ends of the switch such that the additional bonding pads input turn-off signals to turn of the switches when the testing process ends.

In view of the above, at least one set of switches is arranged between the shorting bars and the bonding pads. The switches are turn on upon receiving the testing signals from the shorting bars so as to transmit the testing signals to the bonding pads. When the testing process ends, the switches are turn off to prevent the liquid crystal panel from being affected by the signals of the bonding pads during the normal screen display of the liquid crystal panel. With such design, the switches are turn on upon the testing process begins and are turn off upon the testing process ends. The testing circuit not only ensures the reliability but also reduce the testing cost for the reason that additional equipment to disconnect the bonding pads and the shorting bar is not needed.

DETAILED DESCRIPTION OF THE EMBODIMENTS

Embodiments of the invention will now be described more fully hereinafter with reference to the accompanying drawings, in which embodiments of the invention are shown.

Figure 1:
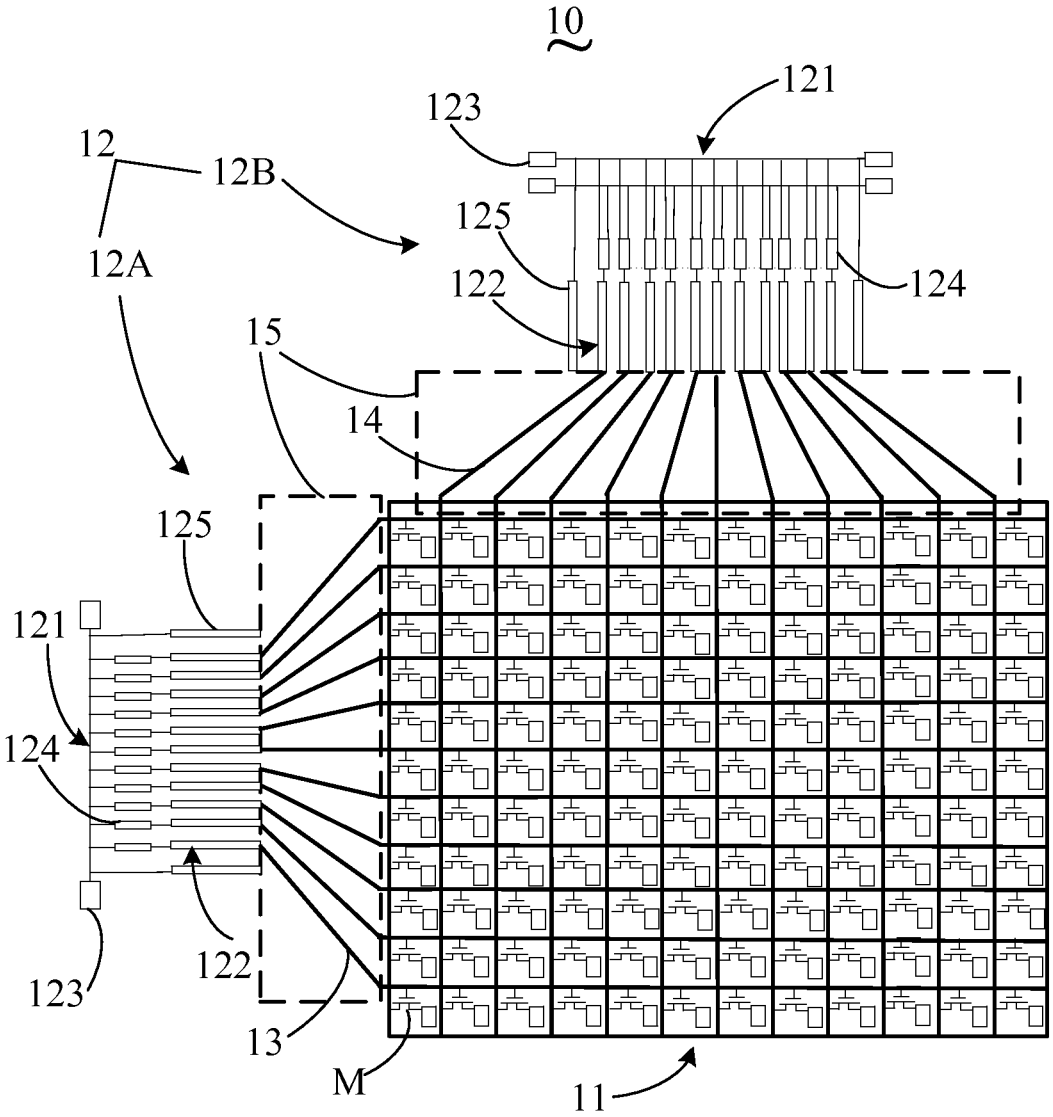
FIG. 1 is a schematic view of the liquid crystal panel having the testing circuit in accordance with a first embodiment.

FIG. 1 is a schematic view of the liquid crystal panel having the testing circuit in accordance with a first embodiment. The liquid crystal panel 10 includes a display area 11 and a testing circuit 12 arranged in a peripheral of the display area 11.

The testing circuit 12 includes a plurality of shorting bars 121 and a plurality of bonding pads 122. Two ends of the shorting bar 121 couple the testing bonding pads 123 so as to obtain testing signals. One end of the bonding pads 122 couples the shorting bar 121, and the other end of the bonding pads 122 couples the display area 11 of the liquid crystal panel 10 so as to transmit the testing signals to the display area 11.

In one embodiment, a plurality of switches 124 are arranged between the bonding pads 122 and the shorting bars 121. After receiving the testing signals, the switch 124 is turn on to transmit the testing signals to the bonding pads 122. When the testing process ends, the switch 124 is turn off to prevent the liquid crystal panel 10 from being affected by the signals of the bonding pads 122. Specifically, two additional bonding pads 125 are respectively arranged on two ends of the bonding pad 122. The additional bonding pad 125 connects to the shorting bar 121 during the normal screen display of the liquid crystal panel. After the testing process ends, turn-off signals, such as the low level signals, are input to the additional bonding pads 125 and then are transmitted to the switches 124 by the shorting bar 121 so as to turn off the switches 124.

By adopting the switches 124, additional equipment to disconnect the bonding pads 122 and the shorting bar 121 is not needed. Thus, the testing cost is reduced. The connection between the bonding pads 122, the shorting bar 121, and the bonding pads 122 will be described hereinafter.

Figure 2:
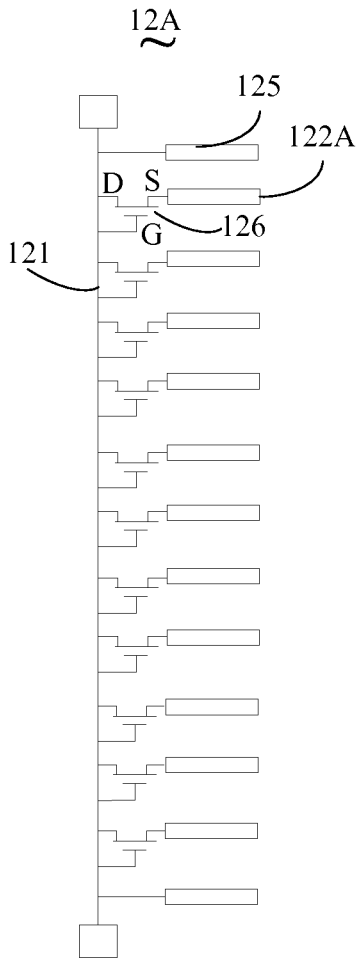
FIG. 2 is an enlarged view of the testing circuits of FIG. 1 viewed from the scanning lines.
Figure 3:
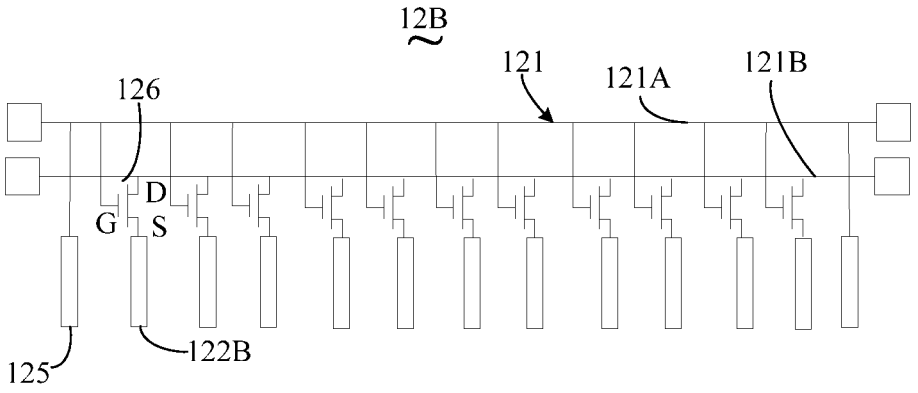
FIG. 3 is an enlarged view of the testing circuits of FIG. 1 viewed from the data lines.

FIG. 2 is an enlarged view of the testing circuit of FIG. 1 viewed from the scanning lines. FIG. 3 is an enlarged view of the testing circuits of FIG. 1 viewed from the data lines. Referring to FIGS. 1, 2, and 3. The testing circuit 12 includes the testing circuit arranged at the scanning line side 12A ("scanning side testing circuit 12A") and the testing circuit arranged at the data line side 12B ("data side testing circuit 12B"). The bonding pads 122 include scanning chips bonding pads 122A and data chips bonding pads 122B. The scanning chips bonding pads 122A are arranged within the scanning side testing circuit 12A. The data chips bonding pads 122B are arranged within the data side testing circuit 12B. In the embodiment, the switches 124 are TFT 126, and the number of the TFT 126 is the same with the number of the bonding pads 122. Within the scanning side testing circuit 12A, the gate (G) and the drain (D) of the TFT 126 connect to the shorting bar 121, the source (S) of the TFT 126 respectively connect to the corresponding scanning chips bonding pads 122A. Within the data side testing circuit 12B, the shorting bar 121 further includes a first shorting bar 121A and a second shorting bar 121B. The gate (G) of the TFT 126 connects to the first shorting bar 121A, the drain (D) connects to the second shorting bar 121B, and the source (S) respectively connect to the corresponding data chips bonding pads 122B. The additional bonding pads 125 connect to the first shorting bar 121A.

The operating mechanism of the testing circuit 12 will be described hereinafter.

When performing the testing process, in the scanning side testing circuit 12A, the testing signals, such as the high level signals, are transmitted to the shorting bar 121 to turn on the TFT 126 and then enter the display area 11 by the scanning chips bonding pads 122A to turn an the transistor (M) in the display area 11. In the data side testing circuit 12B, the testing signals, such as the high level signals, are transmitted to the shorting bar 121 to turn on the TFT 126. The data signals, such as the R, G, B signals, are transmitted from the second shorting bar 121B to the TFT 126, and then are transmitted to the data chips bonding pads 122B to enter the display area 11 so as to display by the transistor (M).

In the embodiment, the testing signals, which are the high level signals of the scanning side testing circuit 12A and the data signals (R, G, B) of the data side testing circuit 12B, are transmitted to the display area 11 via scanning lines 13 and data lines 14. The scanning lines 13 and the data lines 14 respectively form a fan-shaped area 15 between the bonding pads 122 and the display area 11. As the scanning lines 13 and the data lines 14 are closely arranged, short connections may occur in the manufacturing process. Thus, the fan-shaped area 15 also has to be tested. As the testing signals are transmitted to the display area 11 by the scanning lines 13 and the data lines 14, the performance of the display area 11 is also used to check whether the fan-shaped area 15 is defective.

Figure 4:
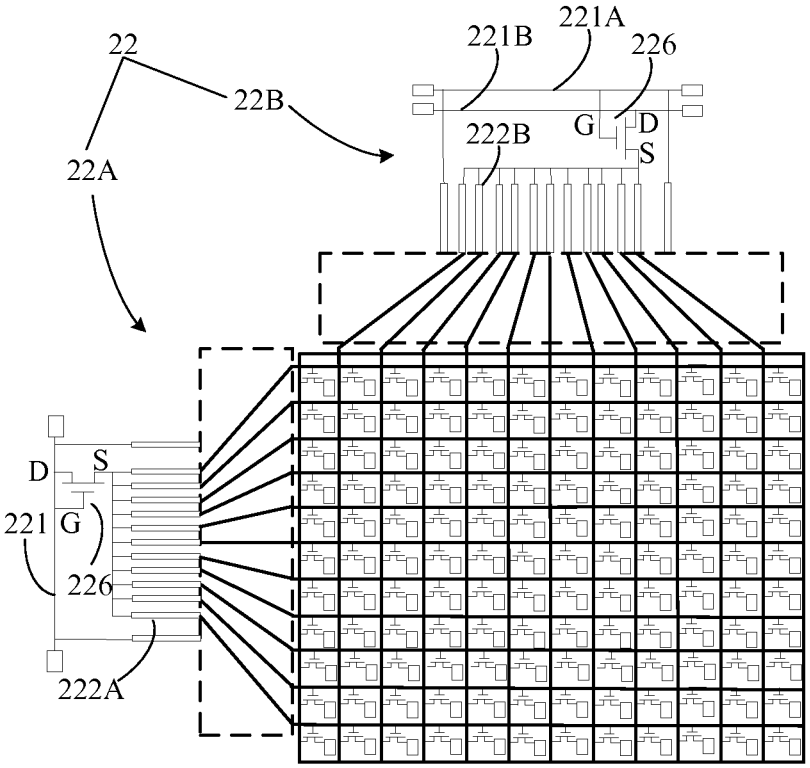
FIG. 4 is a schematic view of the liquid crystal panel having the testing circuit in accordance with a second embodiment.

In one embodiment, in order to further reduce the cost, the testing circuit further includes one TFT set. FIG. 4 is a schematic view of the liquid crystal panel having the testing circuit in accordance with a second embodiment. Referring to FIG. 4, the testing circuit 22 includes the TFT set 226 having one TFT arranged in the scanning side testing circuit 22A and another TFT arranged in the data side testing circuit 22B. In the scanning side testing circuit 22A, the gate (G) and the drain (D) of the TFT 226 connect to the shorting bar 221, and the source (S) of the TFT 226 connects to the bonding pads 222A of the scanning chips. In the data side testing circuit 22B, the gate (G) of the TFT 226 connects to the first shorting bar 221A, the drain (D) connects to the second shorting bar 221B, and the source (S) connects to the data chips bonding pads 222B. The operating mechanism of the testing circuit 22 of FIG. 4 is the same with that of the testing circuit 12 of FIG. 1.

In one embodiment, the testing circuit may include more than one TFT sets as long as the TFT sets can transmit the testing signals in the testing process and can be turn off when the testing process ends. The switches may be other components performing the same functionality as the switches.

In view of the above, the switches are arranged between the shorting bars and the bonding pads such that additional equipment to disconnect the bonding pads and the shorting bar is not needed. On the other hand, the testing circuit can also testing if the fan-shaped area is defective.

Figure 5:
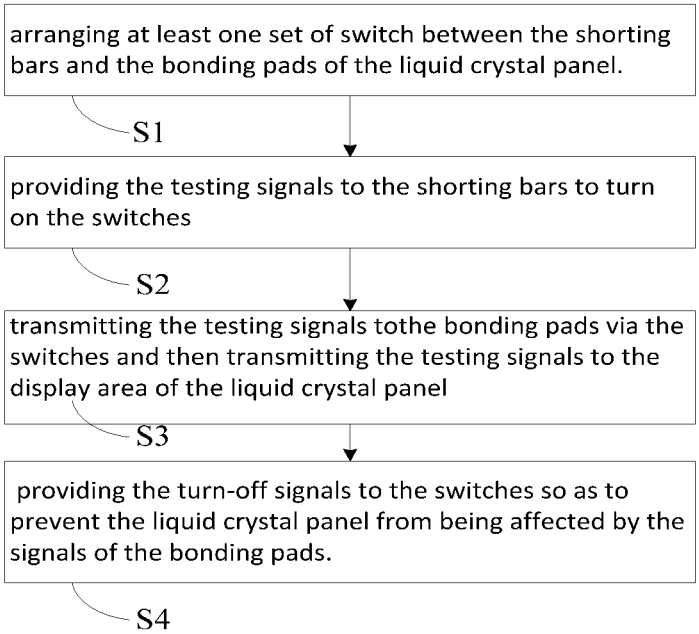
FIG. 5 is a flowchart illustrating the testing method of the liquid crystal panel in accordance with a third embodiment.

FIG. 5 is a flowchart illustrating the testing method of the liquid crystal panel in accordance with a third embodiment. The testing method includes the following steps. In step S1, at least one set of switch is arranged between the shorting bars and the bonding pads of the liquid crystal panel.

In step S2, the testing signals are provided to the shorting bars to turn on the switches. The testing signals may be the high level signals or data signals (R, G, B). In step S3, the testing signals are transmitted to the bonding pads via the switches and are then transmitted to the display area of the liquid crystal panel. In step S4 when the testing process ends, turn-off signals are provided to the switches so as to prevent the liquid crystal panel from being affected by the signals of the bonding pads. Specifically, two ends of the switches are arranged with additional bonding pads. When the testing process ends, the additional bonding pads input the turn-off signals, such as the low level signals, to turn of the switches.

It is believed that the present embodiments and their advantages will be understood from the foregoing description, and it will he apparent that various changes may be made thereto without departing from the spirit and scope of the invention or sacrificing all of its material advantages, the examples hereinbefore described merely being preferred or exemplary embodiments of the invention.

What is claimed is:

1. A testing circuit of a liquid crystal panel, comprising:

the liquid crystal panel comprises a display area, and the testing circuit is arranged in a peripheral of the display area, the testing circuit comprises:

a scanning side testing circuit being arranged at a scanning side and a data side testing circuit being arranged at a data line side, both of the scanning side testing circuit and the data side testing circuit comprising a plurality of shorting bars, two ends of the shorting bar couple testing bonding pads so as to obtain testing signals from the testing bonding pads;

a plurality of bonding pads comprising scanning chips bonding pads and data chips bonding pads, the scanning chips bonding pads being arranged within the scanning side testing circuit, the data chips bonding pads being arranged within the data side testing circuit, one end of the bonding pads couples with the shorting bar, and the other end of the bonding pads couples a display area of the liquid crystal panel so as to transmit the testing signals to the display area;

wherein at least one set of switches is arranged between the bonding pads and the shorting bars, the switches are turn on upon receiving the testing signals, and then transmit the testing signals from the shorting bars to the bonding pads in a testing process, and the switches are turn off when the testing process ends so as to prevent the liquid crystal panel from being affected by the signals of the bonding pads when the liquid crystal panel displays normally;

wherein two additional bonding pads are respectively arranged on two ends of the bonding pad, and turn-off signals are inputted to the additional bonding pads and are transmitted to the shorting bars so as to turn off the switches after the testing process ends.

2. The testing circuit as claimed in claim 1, wherein the switch is a thin film transistor (TFT).

3. The testing circuit as claimed in claim 2, wherein one end of the scanning chips bonding pad connects to a source of the TFT, and a gate and a drain of the TFT connect to the shorting bar.

4. The testing circuit as claimed in claim 3, wherein the shorting bar comprises a first shorting bar and a second shorting bar, one end of the data chips bonding pad connects to the source of the TFT, the gate of the TFT connects to the first shorting bar, and the drain of the TFT connects to the second shorting bar.

5. The testing circuit as claimed in claim 4, wherein the additional bonding pads connect to the first shorting bar.

6. The testing circuit as claimed in claim 2, wherein the testing circuit comprises one TFT set, the gate and the drain of the TFT connect to the shorting bar, and the source of the TFT connects to the corresponding bonding pads.

7. The testing circuit as claimed in claim 2, wherein the testing circuit comprises a plurality of TFT sets, a number of the switches is the same with the number of the bonding pads, the gate and the drain of the TFT connect to the shorting bar, and the source of the TFT connects to the corresponding bonding pads.

8. A liquid crystal panel, comprising:

a display area and a testing circuit arranged in a peripheral of the display area the testing circuit comprises:

a scanning side testing circuit being arranged at a scanning side and a data side testing circuit being arranged at a data line side, both of the scanning side testing circuit and the data side testing circuit comprising a plurality of shorting bars, two ends of the shorting bar couple testing bonding pads so as to obtain testing signals from the testing bonding pads;

a plurality of bonding pads comprising scanning chips bonding pads and data chips bonding pads, the scanning chips bonding pads being arranged within the scanning side testing circuit, the data chips bonding pads being arranged within the data side testing circuit, one end of the bonding pads couples with the shorting bar, and the other end of the bonding pads couples a display area of the liquid crystal panel so as to transmit the testing signals to the display area;

wherein at least one set of switches is arranged between the bonding pads and the shorting bars, the switches are turn on upon receiving the testing signals, and then transmit the testing signals from the shorting bars to the bonding pads in a testing process, and the switches are turn off when the testing process ends so as to prevent the liquid crystal panel from being affected by the signals of the bonding pads when the liquid crystal panel displays normally;

wherein two additional bonding pads are respectively arranged on two ends of the bonding pad, and turn-off signals are inputted to the additional bonding pads and are transmitted to the shorting bars so as to turn off the switches after the testing process ends.

9. The liquid crystal panel as claimed in claim 8, wherein the switch is a thin film transistor (TFT).

10. The liquid crystal panel as claimed in claim 9, wherein one end of the scanning chips bonding pad connects to a source of the TFT, and a gate and a drain of the TFT connect to the shorting bar.

11. The liquid crystal panel as claimed in claim 10, wherein the shorting bar comprises a first shorting bar and a second shorting bar, one end of the data chips bonding pad connects to the source of the TFT, the gate of the TFT connects to the first shorting bar, and the drain of the TFT connects to the second shorting bar.

12. The liquid crystal panel as claimed in claim 11, wherein the additional bonding pads connect to the first shorting bar.

13. The liquid crystal panel as claimed in claim 9, wherein the testing circuit comprises one TFT set, the gate and the drain of the TFT connect to the shorting bar, and the source of the TFT connects to the corresponding bonding pads.

14. The liquid crystal panel as claimed in claim 9, wherein the testing circuit comprises a plurality of TFT sets, a number of the switches is the same with the number of the bonding pads, the gate and the drain of the TFT connect to the shorting bar, and the source of the TFT connects to the corresponding bonding pads.

15. A testing method of a liquid crystal panel, comprising;

arranging at least one set of switch between shorting bars and bonding pads of a scanning side testing circuit being arranged at a scanning side and of a data side testing circuit being arranged at a data line side of the liquid crystal panel, the bonding pads comprising scanning chips bonding pads and data chips bonding pads, the scanning chips bonding pads being arranged within the scanning side testing circuit, the data chips bonding pads being arranged within the data side testing circuit;

providing testing signals to the shorting bars to turn on the switches;

transmitting the testing signals to a display area of the liquid crystal panel after the testing signals enter the bonding pads via the switches;

providing turn-off signals to the switches when a testing process ends so as to prevent the liquid crystal panel from being affected by the signals of the bonding pads while the liquid crystal panel displays normally; and wherein when the providing step further comprises arranging additional bonding pads on two ends of the switch such that the additional bonding pads input turn-off signals to turn off the switches when the testing process ends, and wherein a number of the switches is the same with the number of the bonding pads.

* * * * *